United States Patent [19]

Schoofs

[11] Patent Number: 4,521,220

[45] Date of Patent: Jun. 4, 1985

[54] SWIM FIN FOR BREASTSTROKE SWIMMERS

[76] Inventor: Mark J. Schoofs, 1635 School St., P.O. Box 67, Moraga, Calif. 94556

[21] Appl. No.: 657,576

[22] Filed: Oct. 3, 1984

Related U.S. Application Data

[63] Continuation of Ser. No. 474,505, Mar. 11, 1983, abandoned.

[51] Int. Cl.[3] ..... A63B 31/11

[52] U.S. Cl. ..... 441/64

[58] Field of Search ..... 441/60, 61, 62, 63, 441/64; D21/239; 941/55, 56, 57, 58, 59; 440/14

[56] References Cited

U.S. PATENT DOCUMENTS

| | | | |
|---|---|---|---|
| 1,705,738 | 3/1929 | Schwalge | 441/64 |
| 2,423,571 | 7/1947 | Wilen | 441/64 |
| 2,588,363 | 3/1952 | De Corlieu | 441/64 |
| 2,975,438 | 3/1957 | Magone | 491/59 |
| 3,015,829 | 1/1962 | Gronkowski | 441/60 |
| 3,987,509 | 10/1976 | Patterman | 441/64 |
| 4,310,938 | 1/1982 | Eichler | 441/64 |

FOREIGN PATENT DOCUMENTS

| | | | |
|---|---|---|---|
| 53556 | 2/1934 | Norway | 441/61 |

*Primary Examiner*—Trygve M. Blix
*Assistant Examiner*—Thomas J. Brahan
*Attorney, Agent, or Firm*—Limbach, Limbach & Sutton

[57] ABSTRACT

A swim fin for use by breaststroke swimmers is described. The swim fin has a shoe-like rear compartment and a closed forward extension from said compartment. The forward extension has a relatively flat bottom surface and a curved convex upper surface, so cambered that the thickness of the extension at its inner side is substantially the thickness at the outer side.

2 Claims, 2 Drawing Figures

SWIM FIN FOR BREASTSTROKE SWIMMERS

This is a continuation of application Ser. No. 474,505 filed Mar. 11, 1983, now abandoned.

DESCRIPTION

1. Technical Field

This invention relates to a swim fin particularly adapted to use by breaststroke swimmers.

2. Background Art

Swim fins of varying design are in commercial use. These fins while varying in specific design, all have the common feature of increasing the surface sole area in contact with the water. They are used by skin divers and are used by swimmers whose styles are characterized by leg motions or kicks which are essentially a movement of the legs and feet in a vertical plane.

Contrary to popular belief, the feet of a competent breaststroke swimmer do not drive the swimmer forward as a result of pressing the soles of the feet backward against the water. The swim fins currently commercially available are essentially useless to a breaststroke swimmer who attempts a proper breaststroke kick while wearing them.

Various swimming styles and swimmming aids are described in "Howard Firby on Swimming", Pelham Books, Ltd., 52 Bedford Square, London.

BRIEF DESCRIPTION OF THE INVENTION

In a properly executed breaststroke the swimmer lies prone in the water with his legs fully extended. To kick, the swimmer draws his heels up to his buttocks by bending his knees and then points his toes outward (away from each other) and whips his feet outward and around through a quarter circular path, bringing them together fully extended at the end of the kick. There is essentially no direct backward push of the soles of the feet against the water.

The swim fin of the present invention comprises a shoe-like rear compartment for receiving a human foot and a closed forward extension from that compartment. The forward extension has a relatively flat bottom surface and a convex upper surface which is cambered so that the thickness of the extension adjacent the inner side of the foot is considerably greater than the thickness of the extension at its outer periphery. The cross section of the extension generally conforms in shape to the cross section of the conventional airplane wing.

DETAILED DESCRIPTION OF THE INVENTION

The swim fin may be constructed from any reasonably flexible light material, such as plastic or rubber or a similar material.

The swim fin is flexible in the sense of being reasonably pliable but it is of sufficient firmness that it holds its shape during passage through water.

The swim fin may be attached to the foot in any convenient manner, for example, it may have a cavity for the anterior portion of the foot and the strap at the heel or it may be attached by a close-fitting foot space as with a slip-on shoe.

Figure 1:
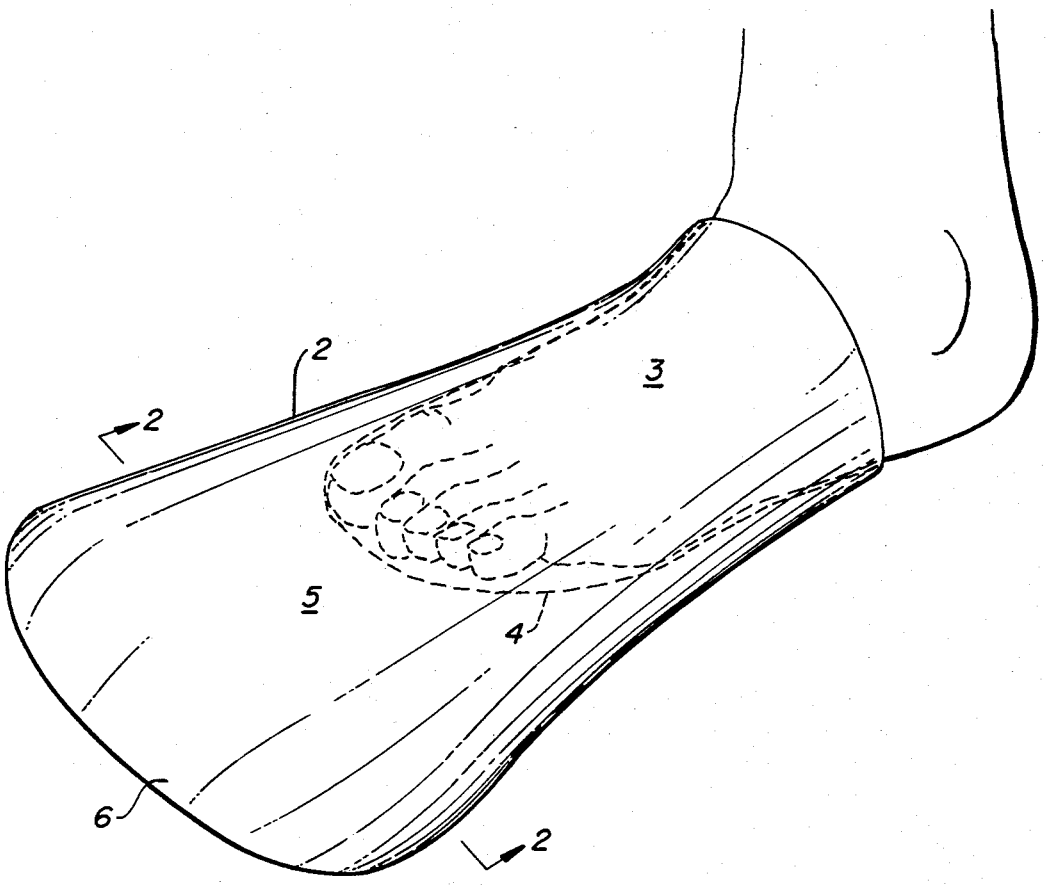
FIG. 1 of the drawings shows the swim fin of the invention fitted on a human foot.

Referring now to FIG. 1 of the appended drawings, the swim fin 2 has a foot-receiving compartment 3 which has a closure member 4 separating the foot compartment from the forward extension 5.

The end of the extension 5 is closed to prevent entry of water into the extension. The closure 6 is made from the same material as the reminder of the swim fin and is fairly blunt in shape. The interior of the forward extension may be hollow or it may be filled, if desired, with a light, solid material, such as foamed plastic.

Figure 2:
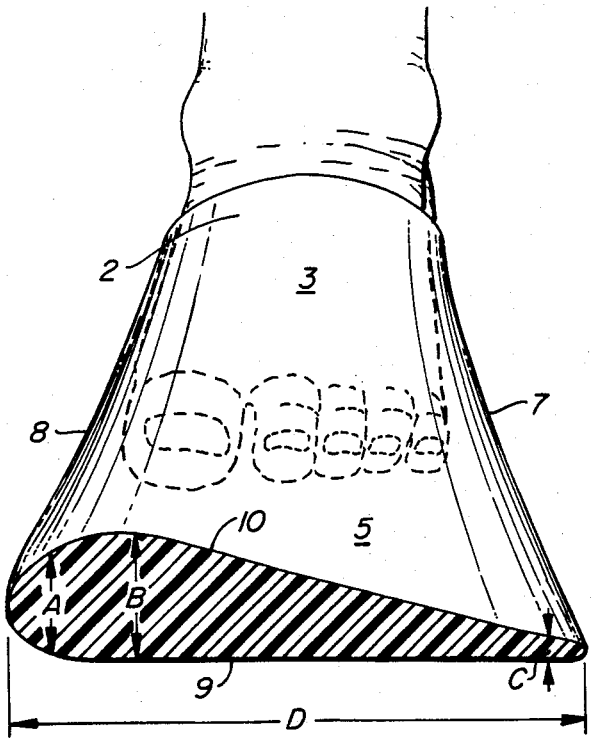
FIG. 2 shows a cross section of FIG. 1 taken along the line 1—1.

FIG. 2 of the drawings shows the swim fin as shown in FIG. 1 but shows the cross-sectional shape of the forward extension. As shown in FIG. 2, the bottom of the forward section 9 is generally flat, whole the top of the cross section 10 is a convex curve so cambered that the thickness of the fin is greater toward the inside 8 of the fin than its thickness closer to the outside 7 of the fin.

Illustrative dimensions for the cross section of the fin are indicated by the letters A, B, C and D where A would suitably be about one inch, B would suitably be from about $1\frac{1}{2}$ to 2 inches, C would suitably be from about $\frac{1}{4}$ to $\frac{1}{2}$ inch and fin width D would suitably be from about 6 to 8 inches.

When the fin as shown in FIG. 2 is in use in breaststroke swimming, the fin moves downward and from right to left of the drawing until the fins on both feet come together at which time the feet of the swimmer are retracted to the buttocks to initiate the next kick.

When the kick is made the feet of the swimmer are somewhat inclined to the vertical with the swimmer's toes being somewhat to the rear of the heels so that the top of the forward extension faces the head of the swimmer. With this posture of the feet and the path of the breaststroke kick the velocity of the water relative to the top surface of the forward extension is greater than the velocity of the water relative to the bottom of the forward extension with the result that a lower pressure exists along the top surface of the forward extension pursuant to the Bernoulli Principle which gives a forward impetus to the swimmer.

I claim:

1. A swim fin for use in breaststroke swimming comprising a shoe-like rear compartment for receiving a human foot and a closed widened forward extension from said compartment, said forward extension having a relatively flat bottom surface and a continuously convex upper surface so cambered that the thickness of the extension adjacent its inner side is greater than its thickness at the outer side and generally conforms in cross-sectional shape to the cross section of an airplane wing, said fin having sufficient firmness to hold its shape during passage through water when in use.

2. A swim fin for use in breaststroke swimming comprising a shoe-like rear compartment for receiving a human foot and a closed widened forward extension from said compartment, said forward extension having a flat bottom surface and a continuously cambered convex upper surface, said surface being so cambered that the maximum thickness of the forward extension lies between the inner and outer sides of said extension and substantially closer to said inner side than to said outer side so that its lateral cross section conforms to that of an airplane wing, said fin having sufficient firmness to hold its shape during passage through water when in use.

* * * * *